United States Patent [19]

Hacker et al.

[11] 4,099,185

[45] Jul. 4, 1978

[54] WINDOW MOUNT ASSEMBLY FOR VERTICAL CB ANTENNA

[75] Inventors: Morris Hacker, Bayside; Dominick Padilla, Bronx, both of N.Y.

[73] Assignee: RMS Electronics, Inc., Bronx, N.Y.

[21] Appl. No.: 746,884

[22] Filed: Dec. 2, 1976

[51] Int. Cl.[2] ..... H01Q 21/00; H01Q 9/26; H01Q 1/08

[52] U.S. Cl. ..... 343/880; 343/803; 343/725

[58] Field of Search ..... 343/725, 763, 766, 816, 343/803, 878, 880, 881, 882, 883

[56] References Cited

U.S. PATENT DOCUMENTS

| | | | |
|---|---|---|---|
| 2,496,646 | 2/1950 | Winer | 343/803 |
| 2,724,053 | 11/1955 | Davis | 343/803 |
| 3,665,478 | 5/1972 | Dempsey | 343/725 |

*Primary Examiner*—Davis L. Willis
*Assistant Examiner*—Harry Barlow
*Attorney, Agent, or Firm*—Hubbell, Cohen, Stiefel & Gross

[57] ABSTRACT

An antenna mounting assembly mountable exteriorly of a window and adapted for use with a vertical CB antenna comprises a bracing member adapted to be secured within the frame of the window; a plurality of horizontal angularly oriented ground plane elements; a boom assembly including a supporting member having a mount section, means for securing the supporting member to the bracing member for orienting the supporting member outwardly from the window and means for swivellingly securing the ground plane elements in a radial arrangement to the mount section, the swivelling of the elements defining a horizontal plane; and means for removably securing the vertical CB antenna to the boom assembly substantially at the center of the radially arranged ground plane elements, the securing means orienting the antenna generally perpendicular to the defined plane whereby the swivelling movement of the ground plane elements in the defined plane is used to increase the directional strength of the signal transmitted from the antenna.

4 Claims, 2 Drawing Figures

WINDOW MOUNT ASSEMBLY FOR VERTICAL CB ANTENNA

BACKGROUND OF THE INVENTION

1. Field of the Invention

This invention pertains to mounting assemblies for antennas and more particularly to a window mount assembly for a CB antenna which provides increased signal transmission quality and permits a conventional vertical CB mobile antenna to be interchangeably used as a CB base station antenna.

2. Prior Art

Window mounts for TV antennas are known. Such mounts include an outwardly biased window bracket for clamping the mounting to the sides of a window. Such an antenna assembly for use with television signals is currently being manufactured by RMS Electronics, Inc., the assignee hereof, as their model # WC-50.

Recently, there has been an increased interest in CB radios and their associated apparatus. While the principal application of CBs is in mobile vehicles such as automobiles and trucks, they also serve extensively at fixed base stations as in houses, garages, apartments, etc. Many people, for example, have CBs in both their cars and their residences.

When considering the best location for mounting of the base station antenna, it should be kept in mind that the same rules apply to CB antennas that apply to other antennas operated in the HF band, i.e., they should be mounted as high and as in the clear as possible. This would dictate that the optimum location for the antenna is on the roof of the structure in which the base station is situated. Unfortunately, however, housing regulations of apartment high rise buildings often prohibit outdoor roof top antennas.

Ideally, a vertical antenna should be installed over a planar ground so that advantage may be taken of low angle radiation which results in increased signal transmission strength. On cars, for example, the center of the automobile roof is generally the best place for mounting. When, however, practical considerations make it impossible to mount the vertical antenna over a planar ground, the practice has been to employ a plurality of ground plane elements which collectively serve as an artificial metallic ground for the antenna and provide low angle radiation of the transmitted signal regardless of the antenna's height above actual ground. As an example of a vertical antenna employing ground plane elements see, for example, U.S. Pat. No. 3,665,478.

U.S. Pat. No. 2,724,053, which discloses a window mounted antenna for TV reception, is particularly ill-suited for use with a vertical CB antenna. Thus, according to that patent, if the antenna were positioned to receive vertically polarized TV signal waves, it would be substantially flush with the window thereby resulting in a drastic reduction in the strength of the received signal. Moreover, no provision is made for varying the horizontal orientation of the antenna once it has been vertically positioned. Further, even if such provision were made, this alone would be ineffective to vary the field strength in any given direction (assuming the antenna was employed for transmitting), inasmuch as the field strength of the signal transmitted from a vertical antenna is uniform in all horizontal directions. Thus, some other means must be developed for providing the increased directional field strength necessary for effective signal transmission from a window mounted vertical CB antenna.

SUMMARY OF THE INVENTION

In accordance with the present invention we have developed a window mount assembly for mounting a vertical CB antenna exteriorly of a window which comprises a bracing member adapted to be secured within the frame of the window; a plurality of horizontal angularly oriented ground plane elements; a boom assembly including a supporting member having a mount section, the supporting member being securable to the bracing member such that the supporting member will be oriented outwardly from the window, and means for swivellingly securing the ground plane elements in a radial arrangement to the mount section of the supporting member such that the swivelling of the ground plane elements defines a horizontal plane; and means for removably securing a vertical CB antenna to the boom assembly substantially at the center of the radially arranged ground plane elements such that the antenna will be oriented generally perpendicular to the plane defined by the swivelling movement of said elements.

By providing the radially arranged ground plane elements with the capability for swivelling movement in a horizontal plane and mounting the antenna substantially at the center of said elements, the effective directional field strength of the signal radiated from the antenna may be increased by suitably adjusting the position of said ground plane elements. By maximizing the directional field strength of the transmitted signal to accomodate CB receivers at different locations, the effect of buildings and other obstructions is minimized. Further, by providing means for removably securing a conventional vertical CB antenna to the window mount assembly, a single vertical antenna may be interchangeably used with other CB units such as a mobile unit or even another base station.

Moreover, due to the particular construction of the window mount assembly according to the present invention, the assembly defines an integral structure which has excellent structural integrity, is inexpensive to manufacture, and yet which may be readily assembled and disassembled.

Other features and advantages of the antenna mount assembly of the invention will appear from the following description and accompanying drawings of a preferred embodiment thereof.

DETAILED DESCRIPTION OF THE PREFERRED EMBODIMENT

Figure 1:
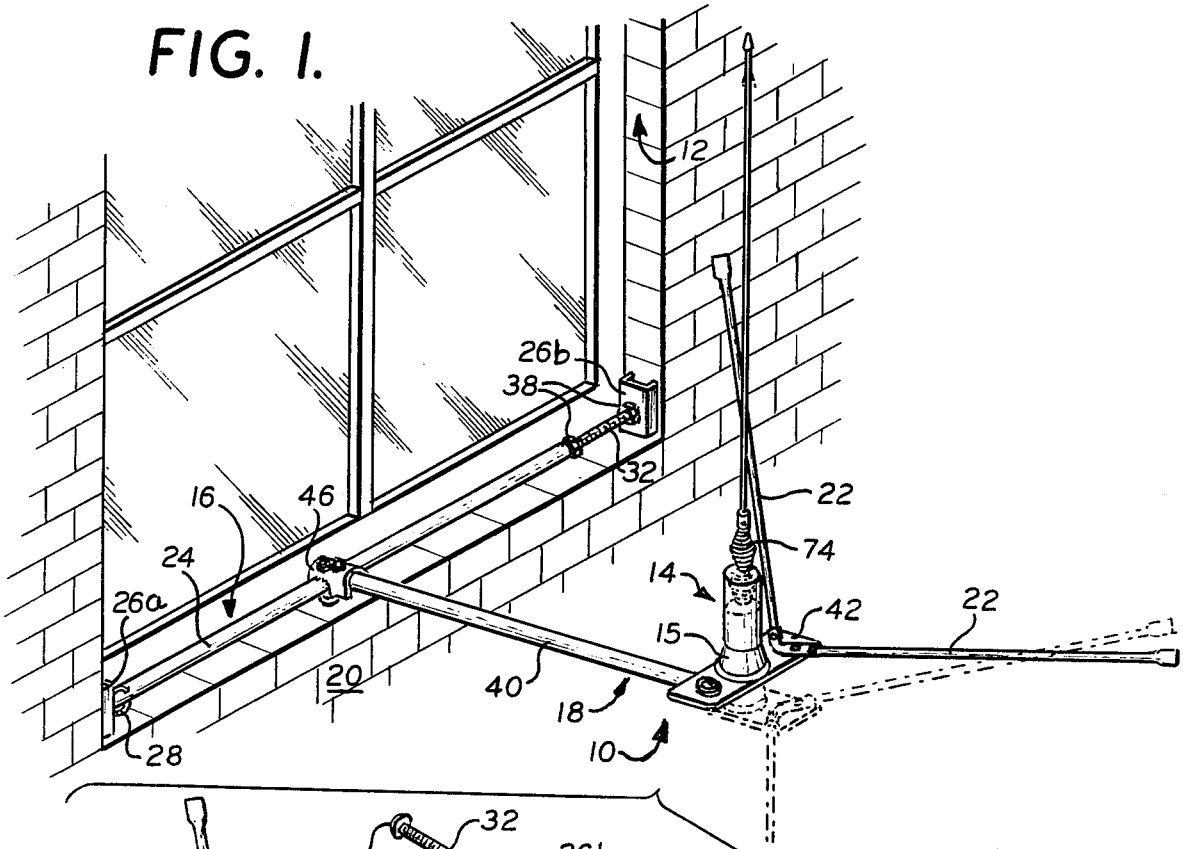
FIG. 1 is a perspective view showing the preferred antenna mounting assembly of the present invention mounted in the frame of a window, the ground plane elements being shown in a first position (dotted lines) and a second position (solid lines)

Referring now to the drawings in detail, and initially to FIG. 1 thereof, the preferred embodiment of the antenna mount assembly 10 of the present invention is illustrated. As shown, the assembly 10 is mounted in a window frame 12 and is adapted for use with a conventional vertical CB antenna 14.

Figure 2:
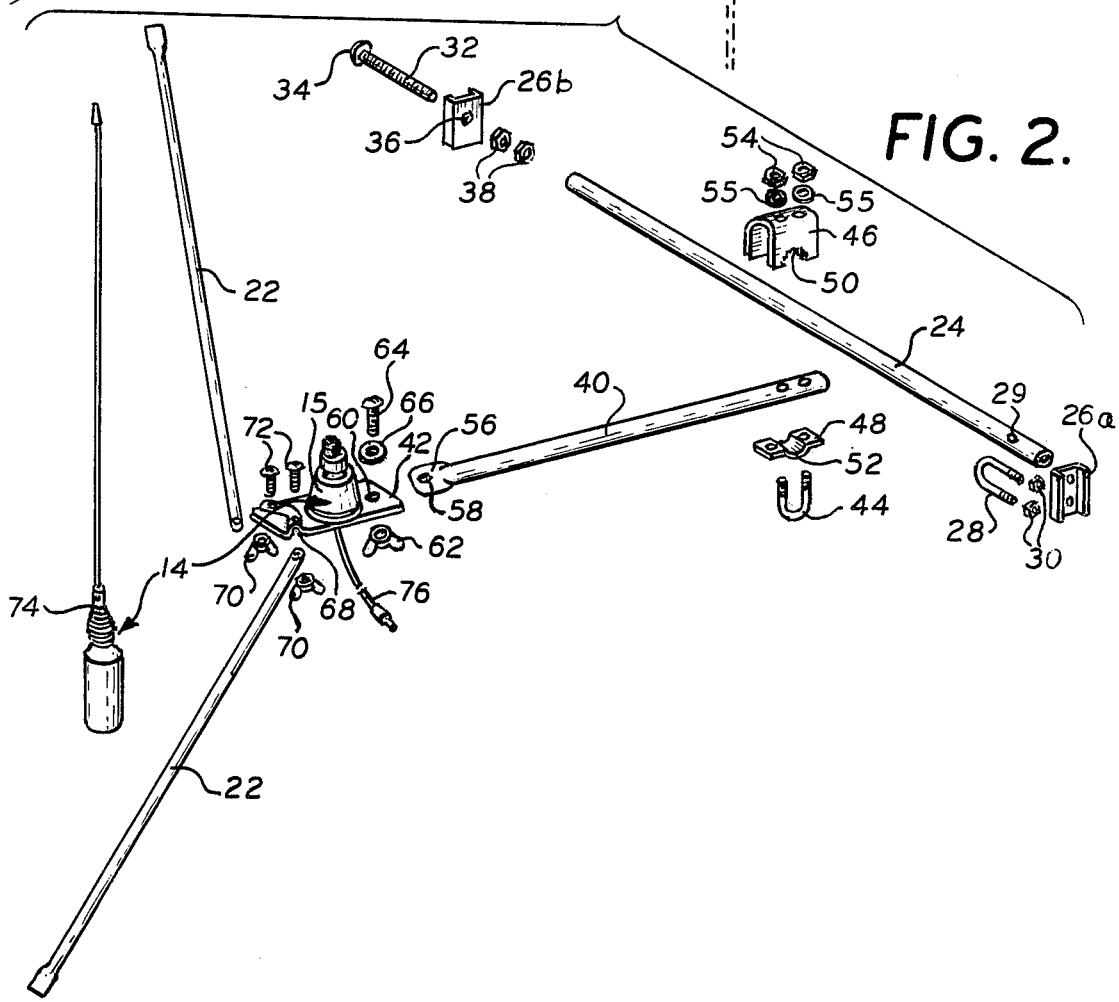
FIG. 2 is an exploded perspective view of the preferred embodiment of the antenna mount assembly of the present invention.

Referring now to FIGS. 1 and 2, the antenna mount assembly 10 includes three principal components, namely, a bracing member 16 receivable within the window frame 12, a boom assembly 18 secured to the bracing member 16 and adapted to extend outwardly from the building wall 20, and a plurality of ground plane elements 22 secured in an angularly oriented radial arrangement to the boom assembly 18. Means are also provided for removably securing the antenna 14 to the boom assembly 18 substantially at the point of intersection of the ground plane elements 22.

As will be more fully explained hereinafter, due to the particular construction of the boom assembly 18, the ground plane elements 22 are swivellable, the swivelling motion of the elements 22 defining a horizontal plane. The swivelling of the ground plane elements 22 permits the directional strength of the signal transmitted from the vertical antenna 14 to be increased thereby minimizing the effect of obstructions such as the building wall 20. Moreover, the assembly 19 has great structural integrity and yet is readily assembled and disassembled to permit easy installation and removal. In addition, the vertical CB antenna 14, being readily removable from the assembly 10, may double as an antenna for a second CB unit when the base station is not in use.

Referring now to FIG. 2 in detail, it is seen that the bracing member 16 comprises a main tubular member 24 having a pair of end brackets 26 secured thereto. One of the brackets **26*a* is adapted to be fixedly secured to one end of the tubular member 24. This may be accomplished, for example, by a generally U-shaped double bolt 28 which extends through a bore 29 in the tubular member 24, the bracket 26*a* being securable to the bolt 28 by the nuts 30. The other end bracket 26*b* is extensibly secured to the other end of the tubular member 24 thus allowing the length of the bracing member 16 to be varied until the end brackets 26 press against opposite sides of the window frame 12, whereby the window antenna mount assembly 10 can be secured within window frames having a variety of widths. As presently preferred and shown, a bolt 32 is threadably mounted in the opposite end of the member 24, the bolt 32 passing through a hole 36 in the element 26*b*. Preferably, the end of the bolt 32 is peened at 34 to maintain end bracket 26*b* thereon even after removal of the assembly 10 from the window frame 12. A pair of nuts 38 are threadably mounted on the bolt 32 between the end bracket 26*b* and the tubular element 24. By varying the length of the portion of the bolt 32 protruding from the end of the member 24, the length of the bracing member 16 may be adjusted. Once the proper length is achieved to clampingly press brackets 26*a* and 26*b* against opposite sides of the window frame 12, one of the nuts 38 is used to secure the end bracket 26*b* between that nut and the peened head 34 of the bolt 32, the other nut 38 being used to lock the position of the bolt relative to the member 24. This is best shown in FIG. 1**.

As presently preferred and shown, the boom assembly 18 comprises two main components, namely, a supporting member 40, one end which is secured to the tubular member 24 of the bracing member 16 to extend outwardly from the building wall 20, and a mounting plate 42 swivellingly secured to the other end of the supporting member 40. While a variety of arrangements will be readily apparent to the skilled art worker for securing the supporting member 40 to the bracing member 16, the arrangement shown in FIGS. 1 and 2 is preferred. Thus, a locking element 46 having a generally U-shaped cross section within which the support member 40 is received, and a locking bracket 48 having a generally U-shaped bend at 52 are employed. As shown, the tubular member 24 is seated in the bend 52 of the bracket 48, a second U-shaped double bolt 44 passing through the bracket 48, the support member 40, and locking element 46. The nuts 54 and flat washers 55 are engagable with the bolt 44 for securing the tubular member 24 and the supporting member 40 in the position shown in FIG. 1. As shown, the locking element 46 is serrated at 50, the serrations serving to prevent rotation of the supporting member 40 about the tubular member 24 thereby insuring that the axis of the supporting member 40 will remain perpendicular to the plane of the building wall 20.

As presently preferred and shown in FIG. 2, the free end of the supporting member 40 is flanged at 56, the flange 56 having a hole 59 therein which is alignable with a hole 60 in the mounting plate 42 such that the plate 42 may be swivellingly secured to the flange 56 such as by the wing nut 62 and bolt 64. Desirably, a lock washer 66 is employed to avoid undesired swivelling of the mounting plate 42 relative to the supporting member 40. As illustrated, the plate 42 has a V-shaped channel 68 running therethrough, the channel 68 having a generally U-shaped cross section for accomodating the ground plane elements 22, one ground plane element being secured within each arm of the V-shaped channel 68, the means for securing the elements 22 within the channel 68 comprising, for example, wing nuts 70 and bolts 72.

Means (not shown) are provided for removably securing the vertical CB antenna to the upper face of the plate 42. Alternatively, and as presently preferred, the base 15 of the antenna 14 may be fixedly secured to the upper face of the plate 42 whereby the main portion 74 of the antenna 14 may be removably secured to the base 15, or to another antenna base located on, for example, a motor vehicle. Wire means, comprising a conventional coaxial cable 76, are provided for electrically connecting the antenna 14 to the CB base station, only the initial portion of the cable 76 being shown in FIG. 2. If desired, and inasmuch as the support member 40 will generally be hollow, the cable 76 may be run through the bore of the member 40 and thence into the CB base station thereby preventing undue exposure of the cable 76 to the elements.

When the CB base station is in use, the antenna mount assembly 10 will be mounted as shown in FIG. 1 with the antenna 14 secured thereto. Owing to the perpendicular orientation of the support member 40 relative to the building wall 20 the antenna 14 is spaced outwardly from the wall 20 thereby increasing both its transmitting and receiving capabilities. However, while spacing of the antenna 14 from the wall 20 does serve to increase the transmitting capabilities of the antenna 14 to a certain extent, the wall 20, nevertheless, does result in a directional radiation pattern from the antenna 14 which severely handicaps the transmitting effectiveness of the CB base station associated with said antenna 14. Thanks to the antenna mount assembly 10, however, this problem is reduced inasmuch as the swivelling movement of the plate 42, and hence of the ground plane elements 22, permits the directional field strength of the signal transmitted from the antenna 14 to be maximized.

Thus, for example, assume that the plate 42 and ground plane elements 22 are initially in a position shown by the dotted lines in FIG. 1 and that the user of the base station is informed that the signal being transmitted is exceptionally weak. The user of the base station may then open the window, slightly loosen the wing nut 62 and then swivel the plate 42 until he is informed that the strength of the transmitted signal has increased. By varying the orientation of the elements 22 while communicating with the receiving unit, the field strength of the signal in the direction of the receiving unit may be maximized. In the example given above, this will be when the mounting plate 42 and ground plane elements 22 are in the position shown by the solid lines in FIG. 1. With the ground plane elements 22 in their optimum position, the effective field strength of the signal transmitted from the antenna 14 will be multiplied by as much as a factor of 2. It will also be appreciated that by employing the configuration shown in FIGS. 1 and 2, the support member 40, which like the elements 22 extends radially horizontally outward from the antenna 14, will function as a third ground plane element. This being so, it is desirable that the member 40 be constructed of a suitable electrically conducting material.

As presently preferred, the bracing member 16, the supporting member 40, and the ground plane elements 22 are all comprised of rigid metallic tubing, the selection of a suitable metal being well within the capabilities of the skilled art worker. Preferably, aluminum, which is inexpensive, rigid, and, with respect to the ground plane has excellent electroconductive characteristics, is employed.

It will be appreciated that various changes may be made in the preferred embodiment described hereinabove without departing from the scope of the invention. Thus, for example, numerous arrangements other than that disclosed above may be provided for mounting the bracing member 16 in the window frame 12. Further, other means for securing the supporting member 40 to the member 16 may be employed. Additionally, means other than the mounting plate 42 are available for securing the ground plane elements 22 and the antenna 14 in the desired orthogonal relation. Also, while two ground plane elements are preferred and shown, more than two ground plane elements 22 may be employed, such additional ground plane elements requiring only minor modification in the window mount assembly shown in FIGS. 1 and 2. While the length of the ground plane elements 22 should preferably be one quarter wave length at the lowest signal transmission frequency, practical considerations dictate that this will generally not be possible in the CB band (approximately 27 MHz) wherein a quarter wave length is about nine feet. Good results may be achieved, however, by using shorter ground plane elements having a length, for example, of about 26 inches. If the supporting member 40 is to double as an additional ground plane element, the selection of its length is subject to the same considerations as apply to the elements 22.

Since these and other variations are within the scope of the present invention, it is intended that the preceding description should be construed as illustrative and not in a limiting sense.

What is claimed is:

1. A window mount assembly for a vertical CB antenna comprising:

(a) a bracing member adapted to be secured within a window frame;

(b) a plurality of angularly related ground plane elements for providing a ground plane for said vertical CB antenna;

(c) a boom assembly including (i) a support member having a mount section, said supporting member being comprised of an electrically conductive material; means for securing the supporting member to said bracing member in outwardly extending relation from said window frame; and (ii) means for securing said ground plane elements to said mount section for swivelling movement in a horizontal plane, said ground plane elements being secured to said mount section in electrical conducting relation with said supporting member, whereby said supporting member serves as an additional ground plane element; and (d) means for removably securing said vertical CB antenna to said boom assembly substantially at the point of intersection of said angularly arranged ground plane elements, said securing means being disposed to orient said antenna vertically, whereby the swivelling of said ground plane elements in said horizontal plane will vary the directional strength of the signal radiated from said antenna.

2. The antenna mounting assembly of claim 1, wherein said supporting member comprises a tubular member having a flange at the free end thereof, said flange comprising said mount section;

wherein said swivelling securing means comprises a plate, means for securing said ground plane elements to said plate in radially extending relation therefrom, bolt means extending through said flange of said tubular member and said plate, and nut means for engaging said bolt means and releasably securing said plate to said flange, the loosening of said nut and bolt means permitting swivelling movement of said plate relative to said flange whereby the swivelling of said plate will move said ground plane elements in said horizontal plane; and wherein said vertical CB antenna is removably mountable on said plate.

3. The antenna mounting assembly of claim 2, wherein said plurality of ground plane elements comprises two ground plane elements; and wherein said means for securing said ground plane elements to said plate comprises a generally V-shaped channel in said plate, one of said two ground plane elements being disposed in each arm of said V-shaped channel; additional bolt means extending through said plate and said ground plane elements; and additional nut means for engaging said additional bolt means and releasably securing said ground plane elements to said plate.

4. The antenna mounting assembly of claim 1 wherein said bracing member is extensible whereby said bracing member may be adapted for securement within window frames of varying sizes.

* * * * *

UNITED STATES PATENT OFFICE

CERTIFICATE OF CORRECTION

Patent No. 4,099,185 Dated July 4, 1978

Inventor(s) Morris Hacker and Dominick Padilla

It is certified that error appears in the above-identified patent and that said Letters Patent are hereby corrected as shown below:

Column 3, line 20: "assembly 19" should read --assembly 10--; and

Column 4, line 19: "hole 59" should read --hole 58--.

Signed and Sealed this

Sixth Day of March 1979

[SEAL]

*Attest:*

RUTH C. MASON
*Attesting Officer*

DONALD W. BANNER
*Commissioner of Patents and Trademarks*